US007160156B2

(12) United States Patent
Holliday

(10) Patent No.: US 7,160,156 B2
(45) Date of Patent: Jan. 9, 2007

(54) CRIMPABLE WIRE CONNECTOR ASSEMBLY

(76) Inventor: Randall A. Holliday, 4360 Augusta Dr., Broomfield, CO (US) 80020

( * ) Notice: Subject to any disclaimer, the term of this patent is extended or adjusted under 35 U.S.C. 154(b) by 0 days.

(21) Appl. No.: 11/066,667

(22) Filed: Feb. 24, 2005

(65) Prior Publication Data

US 2005/0159041 A1 Jul. 21, 2005

Related U.S. Application Data

(63) Continuation-in-part of application No. 10/654,808, filed on Sep. 3, 2003, now Pat. No. 6,935,892, and a continuation-in-part of application No. 10/885,246, filed on Jul. 6, 2004, now Pat. No. 7,059,900, and a continuation-in-part of application No. 10/752,287, filed on Jan. 6, 2004, now Pat. No. 7,044,771.

(51) Int. Cl.
*H01R 9/05* (2006.01)

(52) U.S. Cl. ..... 439/879; 439/585; 439/882

(58) Field of Classification Search ..... 439/877, 439/879–880, 882, 431, 433–434, 805, 500, 439/578, 584–585; 174/84 C
See application file for complete search history.

(56) References Cited

U.S. PATENT DOCUMENTS

| | | | | |
|---|---|---|---|---|
| 2,463,144 | A * | 3/1949 | Buchanan | 439/805 |
| 3,444,505 | A * | 5/1969 | Becker | 439/519 |
| 3,761,602 | A * | 9/1973 | De Sio et al. | 174/73.1 |
| 3,824,556 | A * | 7/1974 | Berkovits et al. | 439/727 |
| 3,846,738 | A * | 11/1974 | Nepovim | 439/584 |
| 4,202,351 | A | 5/1980 | Biche | |
| 4,227,762 | A | 10/1980 | Scheiner et al. | |
| 5,334,044 | A | 8/1994 | Falossi et al. | |
| 5,529,513 | A | 6/1996 | Lee | |
| 6,176,716 | B1 | 1/2001 | Mercurio et al. | |
| 6,406,313 | B1 | 6/2002 | Victor | |
| 6,644,993 | B1 | 11/2003 | Victor | |
| 6,805,583 | B1 * | 10/2004 | Holliday et al. | 439/578 |
| 6,830,479 | B1 * | 12/2004 | Holliday | 439/585 |

* cited by examiner

*Primary Examiner*—Michael C. Zarroli

(57) ABSTRACT

A crimpable universal wire connecter assembly is conformable for use in connecting electrical wires to a post or terminal of an electrical component or for splicing together to other connecter bodies and includes an adapter which is dimensioned to facilitate connection of different gauge wires into one size of connecter body.

25 Claims, 4 Drawing Sheets

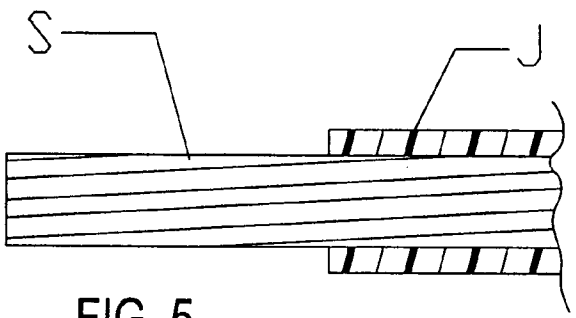
FIG. 5
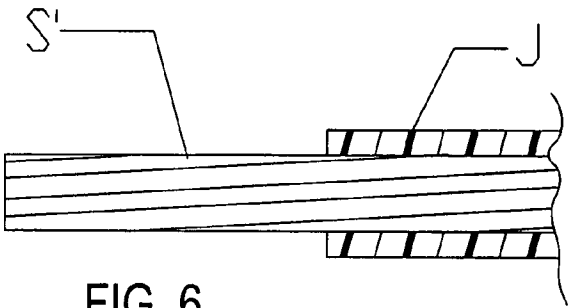
FIG. 6
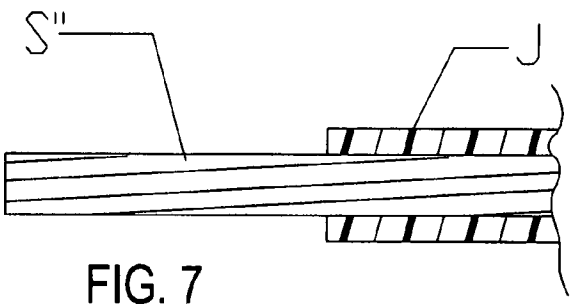
FIG. 7
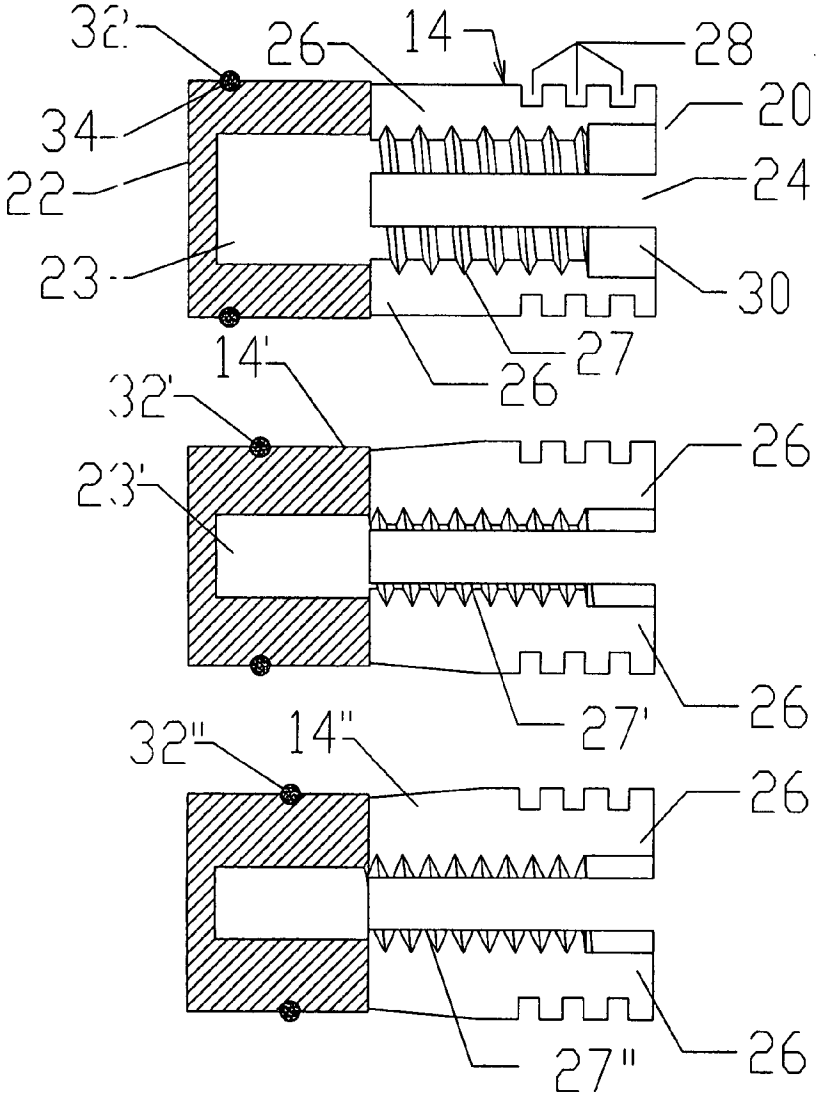

J
W
14
50
44
40
42
12
47
11'
10
49
48
36
35
38
34
37
66

12
14

12
14

J
W
J
12
46
44
14
47
11'
34
4
66

12
39'
14
68
11'
39
11
67
66

CRIMPABLE WIRE CONNECTOR ASSEMBLY

CROSS-REFERENCE TO RELATED APPLICATIONS

This application is a continuation-in-part of patent application Ser. No. 10/654,808, filed 3 Sep., 2003 for ADAPTER FOR MINI-COAXIAL CABLE by Randall A. Holliday, now U.S. Pat. No. 6,935,892, issued 31 Aug., 2006, and incorporated by reference herein; a continuation-in-part of patent application Ser. No. 10/885,246, filed 6 Jul., 2004 for COAXIAL CABLE SPLICE CONNECTER ASSEMBLIES by Randall A. Holliday, now U.S. Pat. No. 7,059,900, issued 13 Jun., 2006, and incorporated by reference herein; and a continuation-in-part of patent application Ser. No. 10/752,287, filed 6 Jan. 2004 for CABLE CONNECTER HAVING INTERCHANGEABLE COLOR BANDS by Randall A. Holliday, now U.S. Pat. No. 7,044,771, issued 16 May, 2006, and incorporated by reference herein.

BACKGROUND AND FIELD OF INVENTION

This invention relates to wire connecters and more particularly relates to a novel and improved wire connecter assembly for interconnecting stranded wires to electronic components, such as, a home entertainment center.

Sound systems customarily utilize stranded wire connecter cables between the terminals of the various components, such as, for example, speakers, amplifiers and tuners. Stranded wires present a different kind of problem than conductor pins in terms of assuring a positive connection with maximum pull-out strength. Stranded wires are somewhat shapeless with a great deal of give and shifting when pressure is applied in connecting to another electrical part or component. Also, the stranded wire is made up of different gauges or diameters depending on the desired signal strength thereby making it difficult to assure a positive connection by the utilization of threaded connecters alone. At the same time, it is highly desirable to be able to employ a standard sized connecter body or shell for connection to the terminal of the electrical component and wherein the body is conformable for use with different types of attachment accessories, such as, spades, banana plugs, pins and sockets as well as to permit interchangeable connection of different gauge connecter wires within a standard size of connecter body.

Representative patents relating to crimpable connecters are U.S. Pat. No. 6,805,583 for MINI-COAX CABLE Connecter AND METHOD OF INSTALLATION and U.S. Pat. No. 6,830,479 for UNIVERSAL CRIMPING Connecter, both by the inventor of this application. Those patents are directed primarily to coaxial cable connecters. Other representative patents are U.S. Pat. No. 6,406,313 to J. E. Victor, U.S. Pat. No. 6,176,716 to G. A. Mercurio et al, U.S. Pat. No. 6,644,993 to J. E. Victor and U.S. Pat. No. 5,529,513 to N. Lee.

SUMMARY OF THE INVENTION

It is therefore an object of the present invention to provide for a novel and improved stranded wire connecter assembly.

It is another object of the present invention to provide for a novel and improved stranded wire connecter assembly which is conformable for interchangeable connection of one or more different gauge wires to a post or terminal in a fast, reliable manner.

It is another object of the present invention to provide for a novel and improved wire connecter assembly which is conformable for use as an end connecter for connection to the posts or terminals of electrical components, and to wall outlets either as an end connecter or splice connection in an efficient and reliable manner.

A further object of the present invention is to provide for a positive connection with maximum pull-out strength between the end of a multi-stranded wire and a connecter body which is adapted for connection to a post or terminal of an electronic component; and each connecter body is distinctly coded in such a way as to indicate whether it is to be connected to a positive or negative terminal as well as a particular speaker or speaker location to which it is to be attached.

It is an additional object of the present invention to provide a crimpable wire connecter assembly which will assure positive connection between different gauge wires and a post or terminal of an electrical component; and further wherein novel and improved adapters are sized for different size or gauge wires to assure a firm positive connection between the wire and a single size of universal connecter body which is crimpable into engagement with the adapter.

A still further object of the present invention is to provide in a cable or wire connecter assembly for a novel and improved adapter which will facilitate crimping of different sized wires into a connecter body, each different size adapter being visually coded to designate a particular gauge wire attached to the adapter.

In accordance with the present invention, a fitting which is adapted for connecting one end of an electrically conductive wire to another electrically conductive member, an adapter has a hollow generally cylindrical body which is open at least at one end, an internally threaded wall portion in the body which is dimensioned to receive and to threadedly engage said end of the wire, a connecter body including a connecter sleeve into which the adapter is inserted, and means for crimping the adapter into positive engagement with the wire. A plurality of adapters are provided for each connecter assembly in which the internally threaded wall portions are sized to match up with a different gauge wire but the outer diameters of the adapters are the same in order to use the same or consistent size connecter body for the different gauge wires, and the adapters are further characterized by being slotted to form arcuate segments at the entrance end of the adapter for insertion of the wire, the slots being dimensioned to limit the inward radial contraction of the segments into clamping engagement with the end of the wire.

The connecter bodies of the present invention are conformable for use in splice connection assemblies for splicing together wires of the same or different gauges and in which the connecter bodies are fit with complementary male and female connecting end portions; also, one of the connecter bodies may be mounted in a wall plate or an electrical outlet which, for example, may include an outlet box into which one of the wires extends for installation in one of the connecter bodies.

The above and other objects, advantages and features of the present invention will become more readily appreciated and understood from a consideration of the following detailed description of preferred and modified forms of the present invention when taken together with the accompanying drawings in which:

BRIEF DESCRIPTION OF THE DRAWINGS

FIGS. 5, 6 and 7 are exploded, longitudinal section views of different gauge wires preliminary to insertion into an adapter sleeve which is dimensioned according to the wire gauge to be inserted;

DETAILED DESCRIPTION OF FIRST PREFERRED EMBODIMENT

Figures 1, 2, 3, 4:
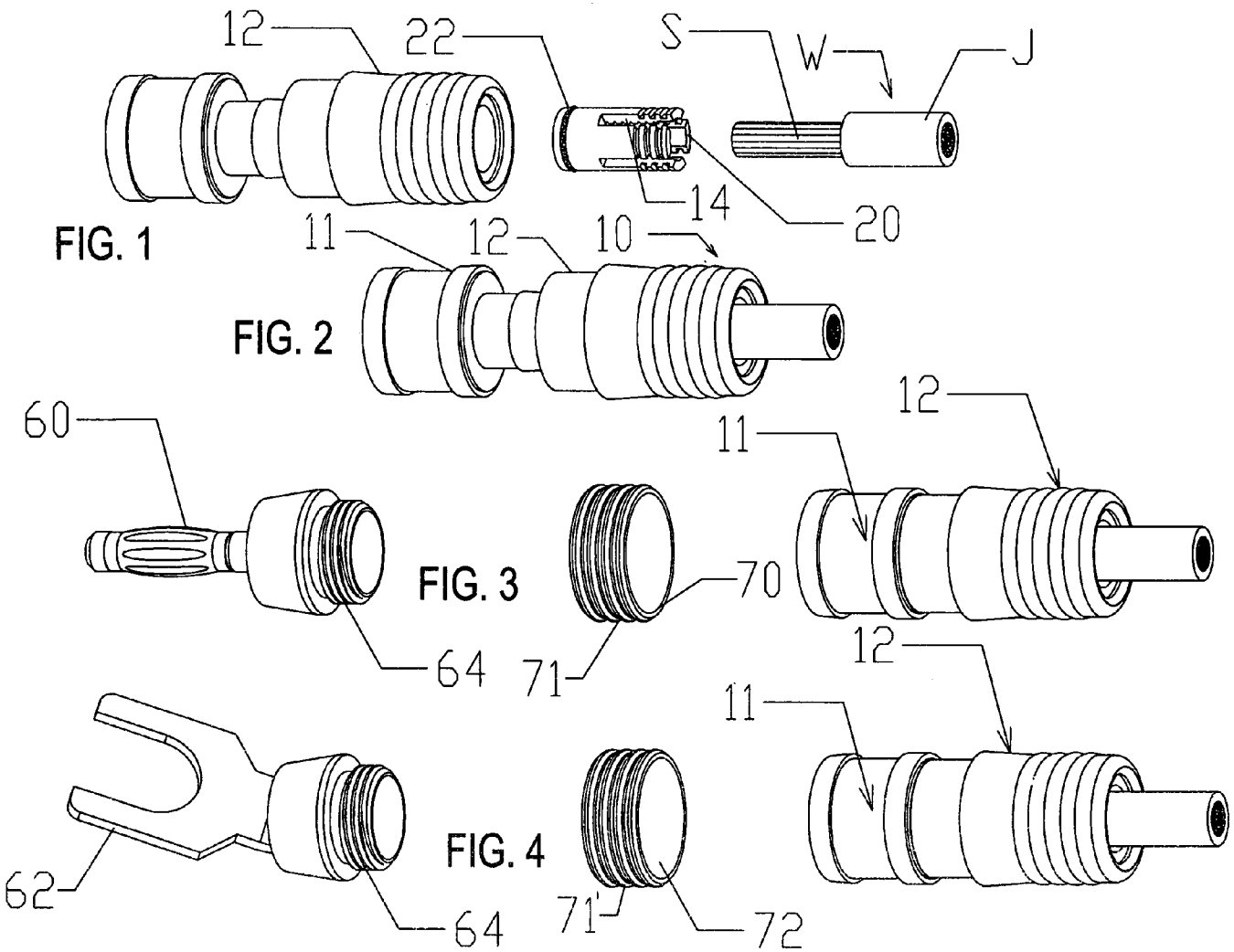
FIG. 1 is an exploded isometric view of a preferred form of wire connecter assembly in accordance with the present invention.
FIG. 2 is another isometric view of the connecter assembly shown in FIG. 1 with the parts assembled.
FIG. 3 is another exploded isometric view of the assembled connecter assembly as shown in FIG. 2 along with a banana plug attachment for securing to a terminal on an electrical component.
FIG. 4 is another isometric view similar to FIG. 3 but illustrating a spade-type of attachment device.

Referring in more detail to the drawings, FIGS. 1 and 2 illustrate a preferred form of wire connecter assembly 10 which is comprised of a generally cylindrical connecter body 11, a crimping member 12, an adapter sleeve 14 and a stranded wire W of standard construction. For example, the wire W is typically made up of an outer jacket J in surrounding relation to multiple strands S of wire which are bundled into a generally spiral configuration. As such, the wire-type connecter is the wire of choice for home entertainment systems and, for example, extends between and electrically connects the speaker terminals and tuner or amplifier terminals.

In order to securely attach the wire W to a terminal, the adapter sleeve 14 is made up of a generally cylindrical sleeve or tube which is open at one end 20 and closed at the opposite end 22. The adapter sleeve 14 is elongated and, as best seen from the detail views of FIGS. 5, 6 and 7, a plurality of circumferentially spaced longitudinal slots 24 divide the greater length of the sleeve 14 into arcuate segments 26 about a common circle. The inner wall portions of the segments 26 are threaded as at 27, and the outer walls of the segments 26 are provided with annular grooves 28. The entrance end 20 of the sleeve 14 is counterbored or enlarged at 30 to permit the wire strands S to advance for a limited distance into the entrance end before contacting the threaded portion 27. The threaded portion 27 in FIG. 5 is dimensioned for a larger gauge stranded wire S so that when the adapter sleeve 14 and wire W are rotated relative to one another in opposite directions the end S will be twisted slightly as it is advanced through the threaded portion then will continue beyond the threaded portion into the space 23 inside of the end cap 22.

FIGS. 6 and 7 illustrate adapter sleeves 14' and 14" respectively for smaller gauge stranded wire and like parts are correspondingly enumerated with prime numerals to those of FIG. 5. In FIG. 6, for example, the stranded wire S' may be a 14 gauge wire and the inner threaded portion 27' is correspondingly made of a smaller size so as to firmly engage the wire S as it is advanced through the threaded portion 27' into the space 23' in the same manner as described with respect to FIG. 5. FIG. 7 illustrates a smaller stranded wire, for example, which maybe a 12 gauge wire. Again, the inner threaded wall portion 27" is dimensioned to be smaller than that of FIG. 6 so as to tightly engage the stranded wire S" as the adapter sleeve 14" is rotatably advanced onto the wire strand.

In order to match the size of one of the adapter sleeves 14, 14' and 14" with that of the wire strands S, S' and S", a designator band or ring 32 is mounted on the external surface of the adapter sleeve adjacent to the end 22. Preferably, the designator is a resilient band of a specific color which is coded to represent a particular size of adapter sleeve and preferably the band is of a frictional material, such as, rubber for a purpose to be described. In addition, the band 32, 32' or 32" is sized so that it can be stretched over the end of the adapter sleeve and placed in a shallow groove 34 in the surface of the end 22, 22' or 22" so as to project beyond the external surface slightly and thereby facilitate engagement with the crimp member 12 in a manner to be described. For example, the ring 32" may be red to represent a 12 gauge sleeve and wire, green to represent a 14 gauge sleeve and wire and yellow to represent a 16 gauge wire.

Figures 8, 9, 10, 11, 12:
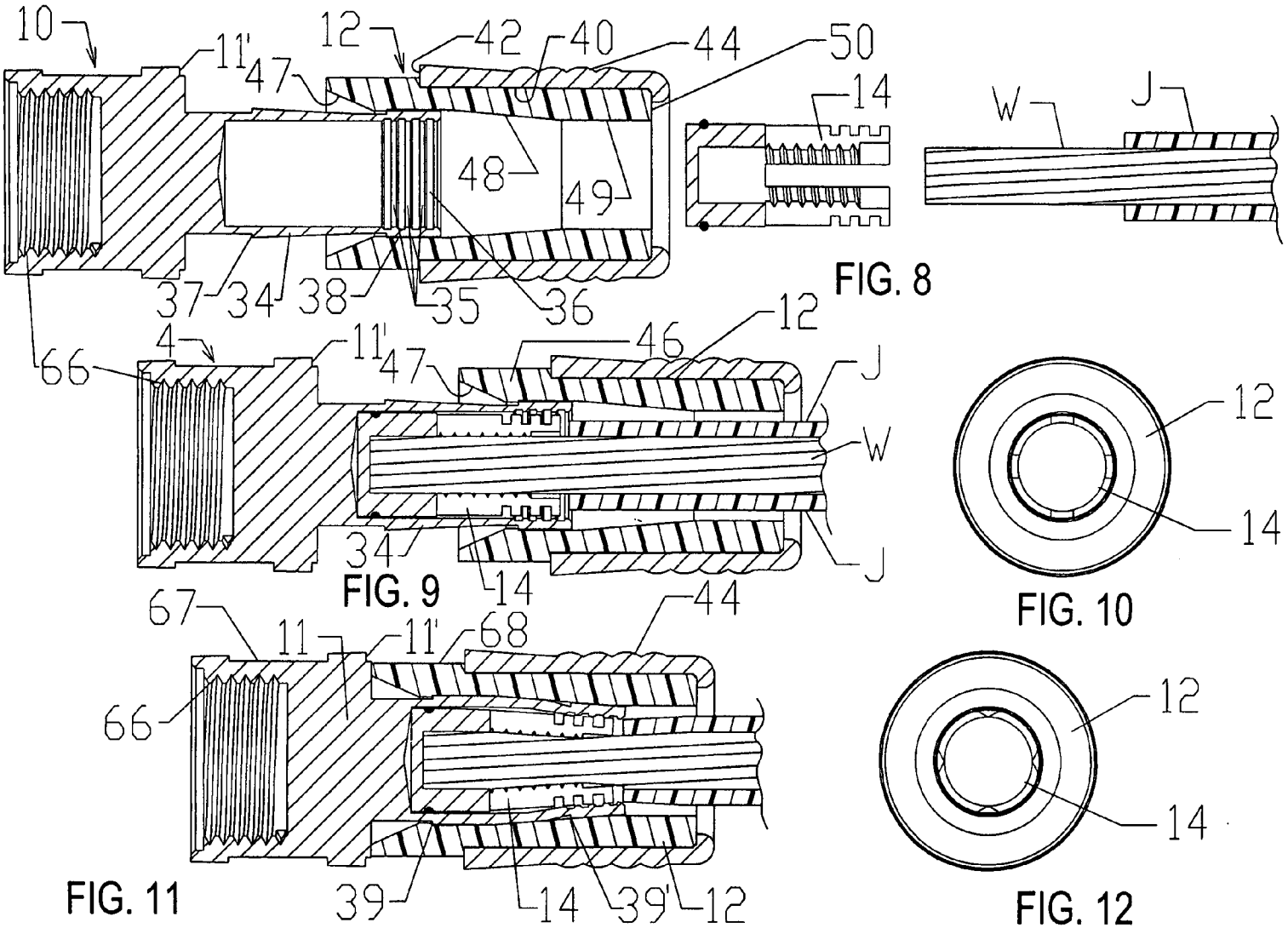
FIG. 8 is another exploded sectional view of the main parts of the preferred form of connecter assembly.
FIG. 9 is a sectional view of the parts shown in FIG. 8 in assembled relation prior to the crimping operation.
FIG. 10 is an end view of FIG. 9.
FIG. 11 is a view of the preferred form in assembled relation following the crimping operation.
FIG. 12 is an end view of FIG. 11.

Although the inner threaded wall portions 27–27" are sized differently to accommodate different gauge wires, the external wall portions 26–26" have the same maximum diameter and which diameter is equal to or slightly smaller than the inner diameter of connecter sleeve 34 at one end of the connecter body 11. The sleeve 34 is elongated to enable full insertion of a selected one of the adapter sleeves 14–14", for example, as illustrated in FIGS. 9 and 11. In addition, the entrance end of the connecter sleeve 34 is provided with a series of axially spaced alternating ribs 35 and grooves 36 along a section in opposed confronting relation to the external grooves 28–28' on the adapter sleeves 14–14". Thus, the ribs 35 will enter the grooves 28 when subjected to crimping pressure in a manner to be described. The external wall surface of the connecter sleeve includes tapered wall sections 37 and 38 so that the body 46 and specifically the inner tapered surface 48 to be described will be forced into engagement against the shoulders 39 and 39' at the ends of the tapered wall sections 37 and 38.

The opposite end of the body 11 to the sleeve 34 is adapted for attachment of different types of terminal connecters, such as, the banana plug connecter 60 shown in FIG. 3 and the spade-type terminal connecter 62 shown in FIG. 4. In a well-known manner, either of the connecters 60 or 62 may be threadedly attached as at 64 to the threaded socket ends 66 illustrated in FIGS. 8, 9 and 11.

The preferred form of crimping member 12, as best seen from FIGS. 8 to 12, includes a ring or body 46 of hollow cylindrical configuration having an outer wall 40 with an inset portion 42 to receive an outer liner 44. The crimping member 12 includes the outer liner 44 which is permanently affixed to the body 46 and typically the outer liner 44 is composed of a material, such as, brass which is permanently affixed to the body 46, and the body 46 is preferably composed of a plastic material having at least a limited compressibility. The body 46 has a first forwardly tapered inner wall surface 47 which is of an increased tapered angle relative to a second inner tapered wall surface 48, and the second tapered wall surface intersects a third wall surface 48 of uniform diameter which terminates in a beveled end surface 50.

In practice, the installer is furnished with sets of adapter sleeves 14, 14' and 14" to be used for the different gauge wires. Of course, additional sizes may be furnished for different gauge wires and marked or designated with an appropriate color ring 32 to designate or represent the size or gauge of wire with which it is to be employed. The installer will then prepare the end of the wire lead or connecter by cutting the insulating jacket J to expose a length of standard wire S which will substantially correspond to the length of the adapter sleeve from the entrance end to the inner surface of the end cap 22. The connecter body 11 is inserted into the tapered end of the crimp member 12 and advanced to the point illustrated in FIG. 9 in which the open end of the sleeve 34 is advanced through the tapered end or wall surface 47 and into contacting relation to the second tapered wall surface 48, as illustrated in FIG. 8. The adapter sleeve 12 and assembled wire W are inserted through the opposite end of the crimp member 12 with the adapter sleeve 12 advancing through the sleeve 34 with the ribs 35 lined up with the grooves 28 on the adapter sleeve so as to be in the open position as illustrated in FIG. 9.

Prior to the actual crimping operation, the O-ring 32 will exert enough frictional force against the inner wall surface of the sleeve 34 to retain the adapter sleeve 14 in the fully inserted position, and the inner wall of the adapter sleeve 12 will exert enough compressive force on the stranded wire by virtue of its threaded engagement to initially retain the wire in position. The open connecter assembly as shown in FIG. 9 is then placed in a suitable crimping tool, such as, that set forth and described in U.S. Pat. No. 6,089,913 or may be a Model CPLCCT-SLM tool manufactured and sold by ICM Corp. of Denver, Colo. in which axially directed forces are applied to opposite ends of the connecter body 11 and crimping member 12 to force the second inner tapered wall surface 48 successively along the external tapered wall surfaces 38 and 37 of the sleeve 34 until the tapered end 47 of the crimping member moves into engagement with the external shoulder 11' on the connecter body 11, as shown in FIG. 11. In this relation, the external tapered wall surface 38 will have advanced into engagement with the inner third wall surface portion 49.

The arcuate segments 26 which make up the slotted end of the sleeve 14 will be compressed by the crimping tool until the facing edges of the segments move into contact with one another so as to limit any further compressive movement but assure positive seal-tight engagement with the stranded wire S. In particular, the slots 24 are dimensioned across their width to limit the degree of inward radial contraction of the segments 26 into clamping engagement with the wire strands S and prevent undue crushing of the strands. The ring or body is preferably composed of a plastic material with sufficient resiliency that it is compressible when forced over the external tapered wall surfaces of the sleeve 34 and, will expand, if necessary, once the arcuate segments 26 of the sleeve reach their full extent of radial inward movement around the stranded wire S. The outer liner 44 as noted earlier is composed of a metal material, such as, brass which is of sufficient hardness to cause the sleeve 34 to be deformed inwardly until the arcuate segments 26 have moved into engagement with one another.

Once the connecter assembly is terminated as described above, appropriate designators may be placed on the external surface to indicate, for example, whether the connecter is to be attached to a + or – terminal as well as to a particular type of component and which will basically depend on the gauge of wire assembled. For example, FIGS. 3 and 4 illustrate mounting of resilient color bands 70 and 72, respectively. For example, the color band 70 may be dyed a particular color as designated by the shading at 71 to represent the color of a positive or negative terminal and will be stretched over the attachment end 66 and seated in groove 67 on the external surface of the connecter body; or in the case of the color band 72 may be stretched over the entire connecter body and into the groove 68 between the connecter body and liner 44 of the crimping member and the shading at 71' may represent the color of a particular speaker or amplifier terminal to which it is to be attached.

Wall-Mounted Splice Connecter Assembly

Figures 13, 14:
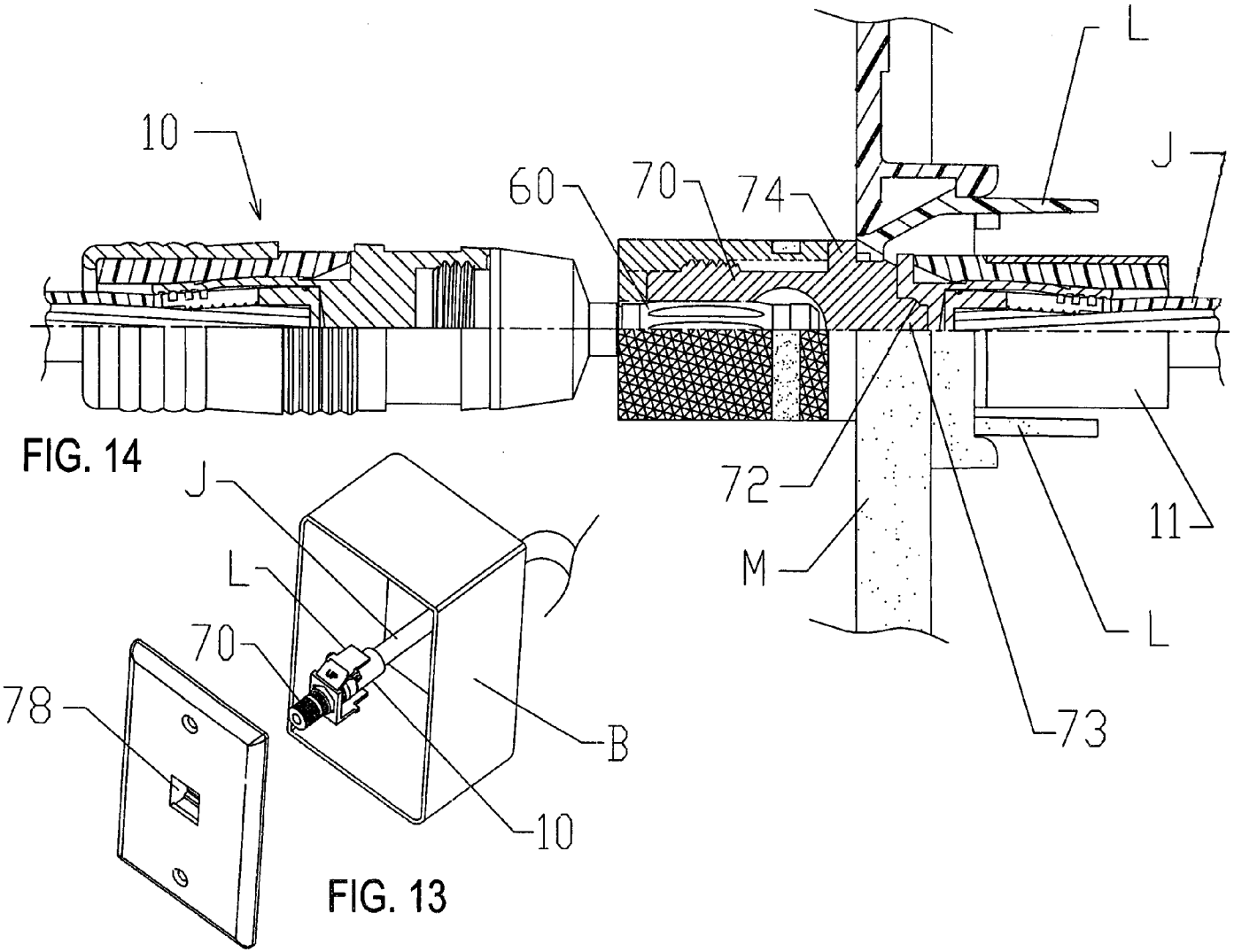
FIG. 13 is an exploded view of a wall mount with an electrical outlet box employing a wire connecter assembly between a stranded wire and the socket outlet.
FIG. 14 is a cross-sectional view in more detail of the wire connecter assembly at the socket end of the wall mount to receive the male end of another wire connecter assembly in accordance with the present invention.

FIGS. 13 and 14 illustrate utilization of the preferred form of wire connecter assembly 10 for attachment of a banana plug 60, as illustrated in FIG. 3, to a socket 70 which projects forwardly from a wall plate M which is mounted on an electrical outlet box B. As shown in FIG. 14, the socket member 70 has a projecting end 73 which is press-fit into cavity 72 at the leading end of connecter body 11, instead of the threaded bore 66 as illustrated in FIGS. 8 to 12. In all other respects the connecter body 11 is identical to the preferred form of wire connecter assembly and therefore like parts are correspondingly enumerated. The same is true of the connecter assembly 10 for the banana connecter 60. The projecting end 73 also includes an external shoulder 74 having standard upper and lower wall clamps L which are inserted into front opening 78 in the wall mount plate M with the end 73 projecting forwardly therefrom.

It will be evident from the foregoing that the wire connecter assembly 10 is readily conformable for use either as an end connecter for connection to the post or terminals of various electronic components or for connection to wall outlets. Further, it is readily conformable for use with different attachments, and the attachments illustrated and described including the banana clip, spade and socket ends are merely given for purposes of illustrations and not limitation. It is therefore to be understood that while preferred forms of invention are herein set forth and described, the above and other modifications may be made therein without departing from the spirit and scope of the invention as defined by the appended claims and reasonable equivalents thereof.

I claim:

1. A fitting adapted for connecting one end of a cable having an electrically conductive portion exposed at said one end thereof to another electrically conductive member, said fitting comprising:

an adapter having a hollow generally cylindrical body which is open at least at one end, an internally threaded wall portion in said body dimensioned to receive and threadedly engage said electrically conductive portion;

a connecter body including a connecter sleeve into which said adapter is inserted; and a cylindrical crimping member having at least one inner tapered annular surface portion extending from a leading end dimensioned to receive said connecter sleeve, said inner tapered annular surface portion disposed in close-fitting engagement with said external wall of said connecter sleeve whereupon axial advancement of said crimping member along said sleeve will impart inward radial deformation to said adapter into tight-fitting engagement with said end of said wire.

2. A fitting according to claim 1 wherein said adapter is elongated and has circumferentially spaced slots extending longitudinally thereof.

3. A fitting according to claim 1 wherein said adapter sleeve has annular grooves in an external wall portion which is engaged by said connecter body.

4. A fitting according to claim 1 wherein said adapter sleeve is provided with a resilient ring on said external wall surface.

5. A fitting according to claim 4 wherein said ring is movable into engagement with said inner tapered surface portion of said crimping ring.

6. A fitting according to claim 1 wherein said crimping ring includes means for designating a positive or negative terminal.

7. A fitting according to claim 1 wherein one end of said connecter body includes means for releasably attaching said connecter body to a post or terminal.

8. In a wire connecter assembly adapted for connecting a selected gauge of a plurality of wires to a terminal on an electrical component, the improvement comprising:

a plurality of adapters each for interchangeable connection to one end of one of said wires, each said adapter having a hollow cylindrical body open at one end, an internally threaded wall portion dimensioned to receive and to threadedly engage an external surface on said end of said wire, each of said threaded wall portions of each of said adapters being of a different diameter in accordance with the gauge of said end of said wire to be connected;

a connecter body having a connecter sleeve into which said adapter is inserted; and means for imparting inward radial deformation to said adapter into positive engagement with said wire.

9. In a wire connecter assembly according to claim 8 wherein said adapters have external wall portions of substantially the same diameter.

10. In a wire connecter assembly according to claim 8 wherein said adapters are elongated and have circumferentially spaced slots extending longitudinally of each of said adapters.

11. In a wire connecter assembly according to claim 8 wherein each of said adapters is closed at one end opposite to the end which receives said end of said wire.

12. In a wire connecter assembly according to claim 10 wherein said slots define arcuate segments therebetween, said slots being dimensioned to limit inward radial contraction of said segments into clamping engagement with said end of said wire.

13. In a wire connecter assembly according to claim 12 wherein said slots are open slots at one end of said adapter and said segments include axially spaced annular grooves in an external wall surface thereof.

14. In a wire connecter assembly according to claim 8 wherein said means is defined by a crimping ring in surrounding relation to said connecter sleeve.

15. In a wire connecter assembly according to claim 14 wherein said crimping ring has at least one inner tapered surface portion slidable along said connecter sleeve to impart inward radial deformation to said connecter sleeve and said adapter.

16. In a wire connecter assembly adapted for connecting a selected gauge of a wire to a terminal on an electrical component, the improvement comprising:

a plurality of adapters for interchangeable connection to one end of said wires, each said adapter having a hollow cylindrical body open at one end, an internally threaded wall portion in said body dimensioned to receive and to threadedly engage an external surface on said end of said wire, each of said threaded wall portions of each of said adapters being of a different diameter in accordance with the gauge of said wire to be connected;

a connecter body having a connecter sleeve into which said adapter is inserted; and a crimping ring having at least one inner tapered annular surface portion for insertion of said connecter sleeve therein whereupon axial advancement of said crimping ring along said sleeve will impart inward radial deformation to said adapter into positive sealed engagement with said wire.

17. In a wire connecter assembly according to claim 16 wherein said adapters are elongated and have circumferentially spaced slots extending longitudinally of each of said adapters to divide one end of each said adapter into a plurality of arcuate segments.

18. In a wire connecter assembly according to claim 17 wherein said slots are open slots at one end of said adapters and said segments each include axially spaced annular grooves in an external wall surface thereof, and said connecter sleeve includes axially spaced ribs on an inner surface thereof in aligned relation to said grooves.

19. A splice connecter for splicing electrically conductive wires to one another comprising:

a pair of connecter bodies having complementary male and female connecting portions for interconnection of said connecter bodies to one another, each of said connecter bodies including a connecter sleeve and an adapter sleeve inserted in said connecter sleeve having an internally threaded wall portion dimensioned to receive and threadedly engage an end of one of said wires, and a crimping member mounted on said connector sleeve including means for imparting inward radial deformation to said connecter sleeve and adapter into positive engagement with said wire.

20. A splice connecter according to claim 19 wherein said adapter is elongated and has circumferentially spaced slots extending longitudinally thereof to define arcuate segments therebetween, said slots being dimensioned to limit inward radial contraction of said segments into clamping engagement with said end of said wire.

21. A splice connecter according to claim 20 wherein said slots are open slots at one end of said adapter and said segments include axially spaced annular grooves in an external wall surface thereof.

22. A splice connecter according to claim 19 wherein a plurality of said adapters are provided for interchangeable connection to one end of a plurality of different gauge wires.

23. A splice connecter according to claim 19 wherein one of said connecter bodies includes means for mounting said one connecter body in a wall.

24. A splice connecter according to claim 23 wherein said mounting means includes a wall plate mounted on an electrical outlet box with said one connecter extending from an opening in said wall plate into said box.

25. A splice connecter according to claim 19 wherein an elastic color band is mounted on an external surface of each of said connecter bodies.

* * * * *